US006988678B1

(12) United States Patent
Chen

(10) Patent No.: US 6,988,678 B1
(45) Date of Patent: Jan. 24, 2006

(54) GARDEN HOSE NOZZLE PROVIDED WITH A WHIRLING ACTION

(75) Inventor: Chin-Yuan Chen, Chang-Hua Hsien (TW)

(73) Assignee: Shin Tai Spurt Water of the Garden Tools, Lu Kang Chen (TW)

( * ) Notice: Subject to any disclaimer, the term of this patent is extended or adjusted under 35 U.S.C. 154(b) by 69 days.

(21) Appl. No.: 10/763,922

(22) Filed: Jan. 26, 2004

(51) Int. Cl.
*B05B 7/02* (2006.01)

(52) U.S. Cl. ..... 239/525; 239/382; 239/389; 239/394; 239/530; 239/586

(58) Field of Classification Search ..... 239/505, 239/513, 391, 394, 525, 526, 586, 587.1, 239/587.5, 587.6, 380, 381, 382, 389, 530
See application file for complete search history.

(56) References Cited

U.S. PATENT DOCUMENTS

| | | | | |
|---|---|---|---|---|
| 6,511,001 | B1 * | 1/2003 | Huang | 239/526 |
| 6,592,057 | B1 * | 7/2003 | Ericksen et al. | 239/587.1 |
| 6,712,294 | B1 * | 3/2004 | Wang | 239/525 |
| 6,726,129 | B2 * | 4/2004 | Kao | 239/587.1 |

* cited by examiner

*Primary Examiner*—Steven J. Ganey
(74) *Attorney, Agent, or Firm*—Alan D. Kamrath; Nikolai & Mersereau, P.A.

(57) ABSTRACT

A garden hose nozzle with a rotary outlet includes a hose nozzle, a hose-connecting, and a water valve. The features of the present invention lie in: the rotary outlet is of a rotary structure. The front end of the hose nozzle is provided with a passage notch, where the connector of the rotary outlet can cross the hose nozzle, and then the insert notch. After the fixation by localizers, a whirling state that the connector and rotary outlet rotate round the insert notch will take shape, so that the hose nozzle with similar grip state can offer flexible applications through variable spraying angle of its whirling design, with the purpose of meeting the customer demands.

5 Claims, 9 Drawing Sheets

GARDEN HOSE NOZZLE PROVIDED WITH A WHIRLING ACTION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a garden hose nozzle, and more particularly to a garden hose nozzle with a whirling effect.

BACKGROUND OF THE INVENTION

The conventional garden hose nozzle is typically designed with a fixed direction, so manual operation shall be required to change its spraying direction. When the spraying objects are located in a higher position, the end-user will find it difficult to hold the hose nozzle continuously. And, as the direction of hose nozzle cannot be adjusted, it is unlikely to place the hose nozzle in a fixed position to spray water automatically. Although an adjustable structure of hose nozzles has been developed by some designers, it does not apply to garden hose nozzles owing to the limited structure of a wand nozzle.

Therefore, based upon aforementioned disadvantages of garden hose nozzle, this industry shall assume the responsibility to make some pioneering R&D and innovations so as to offer a utility model with whirling design.

BRIEF SUMMARY OF THE INVENTION

The present invention is design to:

Provide an innovative garden hose nozzle with a whirling design. This is a preferred option of this Industry in conformity with the requirements of new patent.

Based upon this modified structure design, the hose nozzle with similar grip state can offer flexible applications through variable spraying angle of its whirling design, with the purpose of meeting the customer demands.

DETAILED DESCRIPTION OF THE INVENTION

Figure 1:
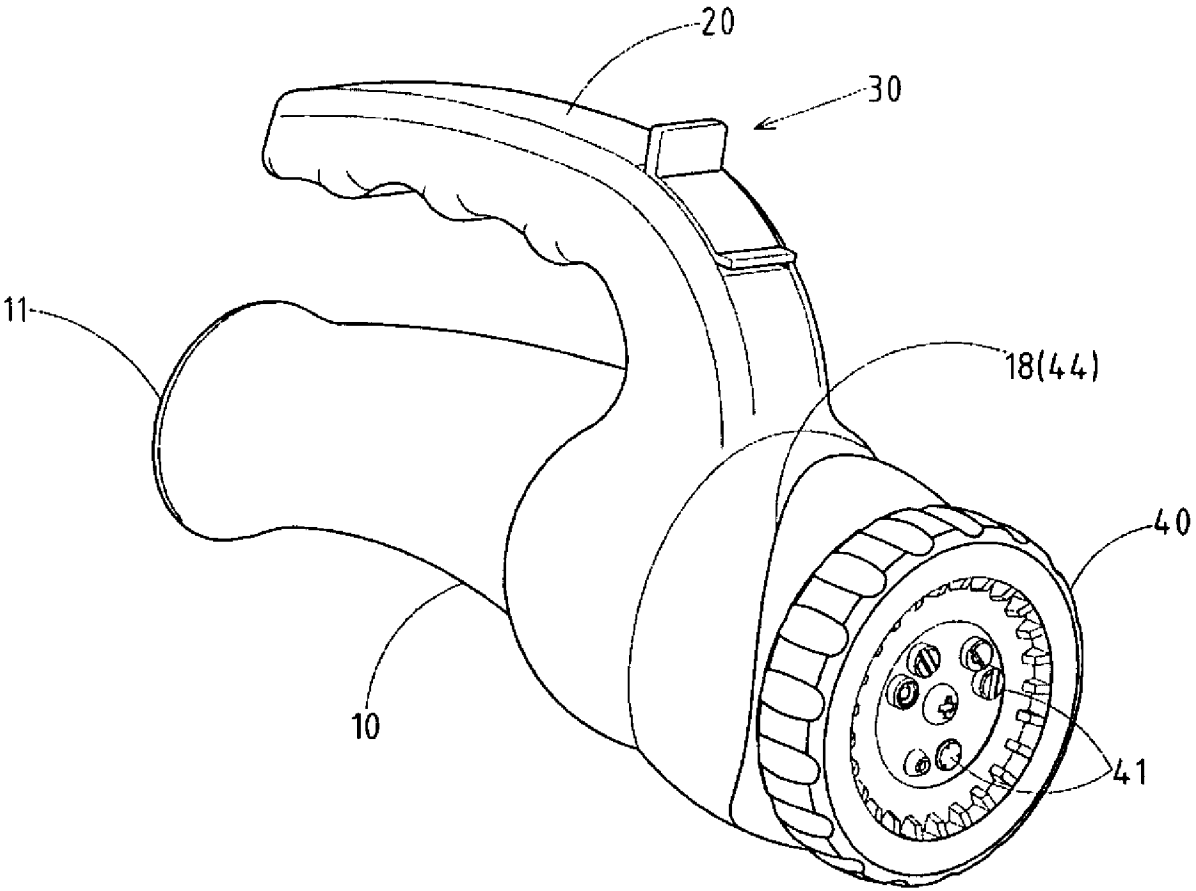
FIG. 1 shows a perspective view of the preferred embodiment of the present invention.

The features and the advantages of the present invention will be more readily understood upon a thoughtful deliberation of the following detailed description of a preferred embodiment of the present invention with reference to the accompanying drawings.

As shown in FIGS. 1–4, a garden hose nozzle embodies the present invention.

Figure 4:
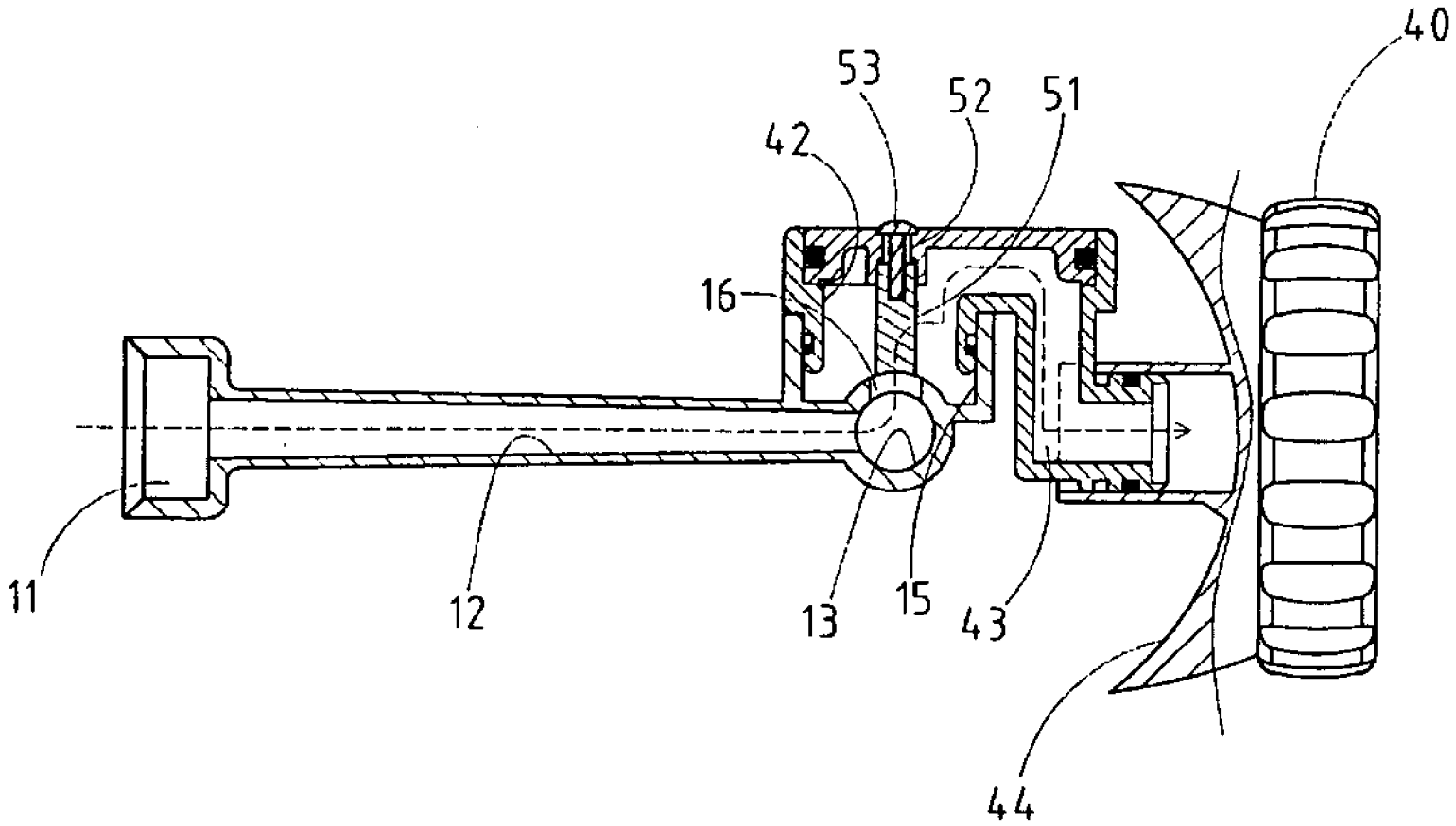
FIG. 4 shows an exploded cross-sectional view, with the water flow at an opening state, corresponding to FIG. 3.
Figure 5:
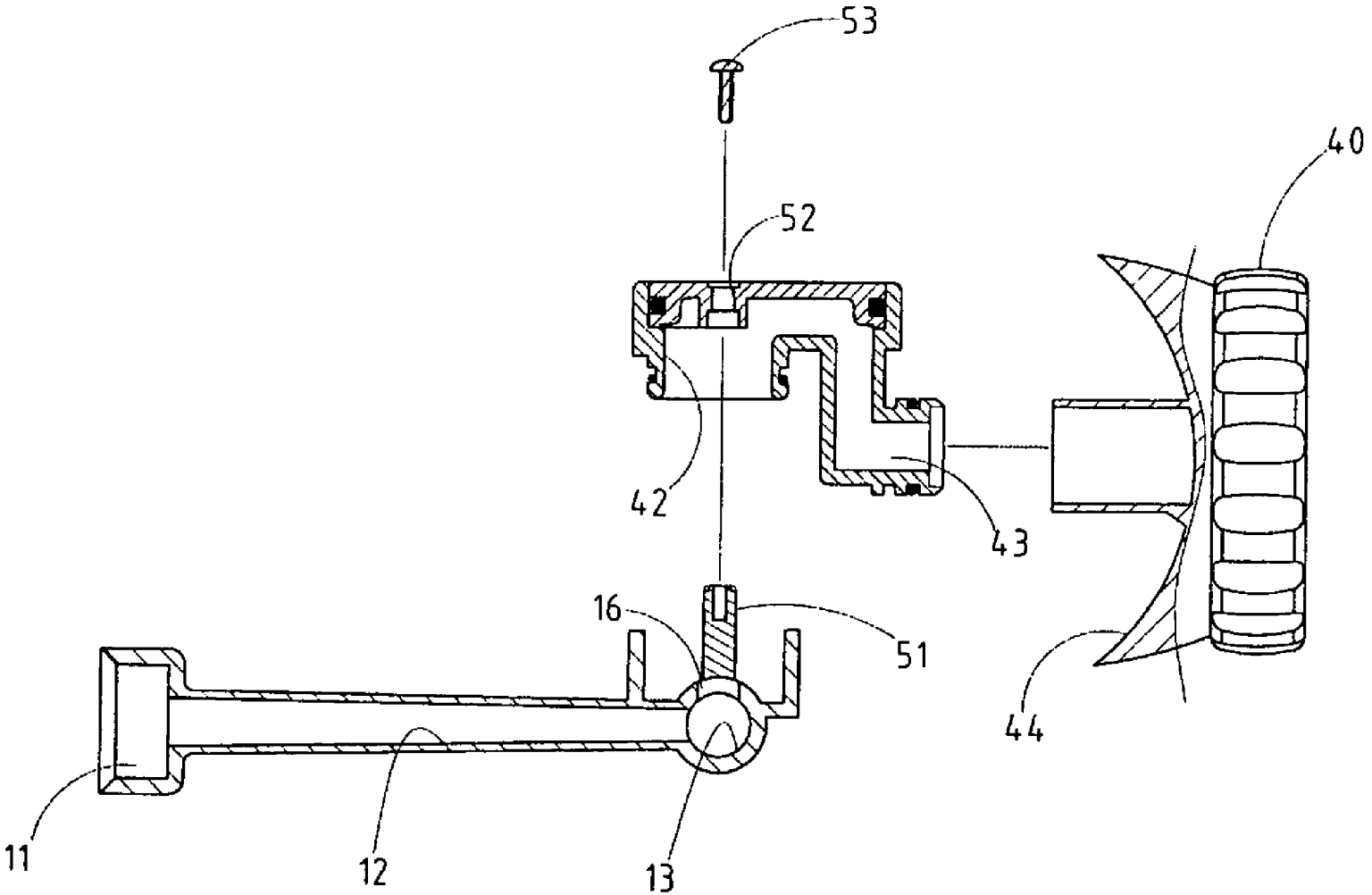
FIG. 5 shows an exploded sectional view of FIG. 4.

A hose nozzle 10, with its outer flank provided with a grip 20 and its back end provided with a hose connecting end 11. The hose connecting end 11 is connected to a conduit 12 within the hose nozzle 10, which is linked to a water valve 13. The water valve 13 is equipped with a water control post 14 that is subjected to the control of a control button 30 outside the hose nozzle 10 for its start-up/close state. A spring 141 is placed between the bottom of the water control post 14 and the lower wall of the water valve 13, so as to enable the water control post 14 to eject toward the control button 30 until a flange 142 of the water control post 14 stops at the shoulder 131 of the water valve 13;

A rotary outlet 40, provided at the front end of the hose nozzle 10. The end surface of the rotary outlet 40 is mounted with a spraying hole 41. As an independent component, the rotary outlet 40 is available with a connector 42 at one side of the hose nozzle 10. There is a water hole 43 within the connector 42 linking to the spraying hole 41. To maintain an insert notch 15 as shown in FIGS. 4 and 5 at the hose nozzle 10's one side adjacent to the water valve 13, the insert notch 15 shall be available with a passage notch 16 connecting the water valve 13. And, the start-up and close state of the passage notch 16 shall be subjected to the control of the water control post 14. The front end of the hose nozzle 10 is provided with a passage notch 17, where the connector 42 of the rotary outlet 40 can cross the hose nozzle 10, and then the above-mentioned insert notch 15 so that the connector 42 can rotate round the insert notch 15 to form a whirling state. After the fixation by localizers, a whirling state that the connector 42 and the rotary outlet 40 rotate round the insert notch 15 as shown in FIG. 5 will take shape, wherein the insert notch 15 functions as the rotation center of the connector 42 when the connector 42 rotates round the insert notch 15, while the rotating angle is subjected to the limitation of the passage notch 17;

An arc dent 44 may be provided at one side of the rotary outlet 40 facing the hose nozzle 10, thus enabling the front end of the hose nozzle 10 to be provided with a shape of an arc convex 18.

Figure 6:
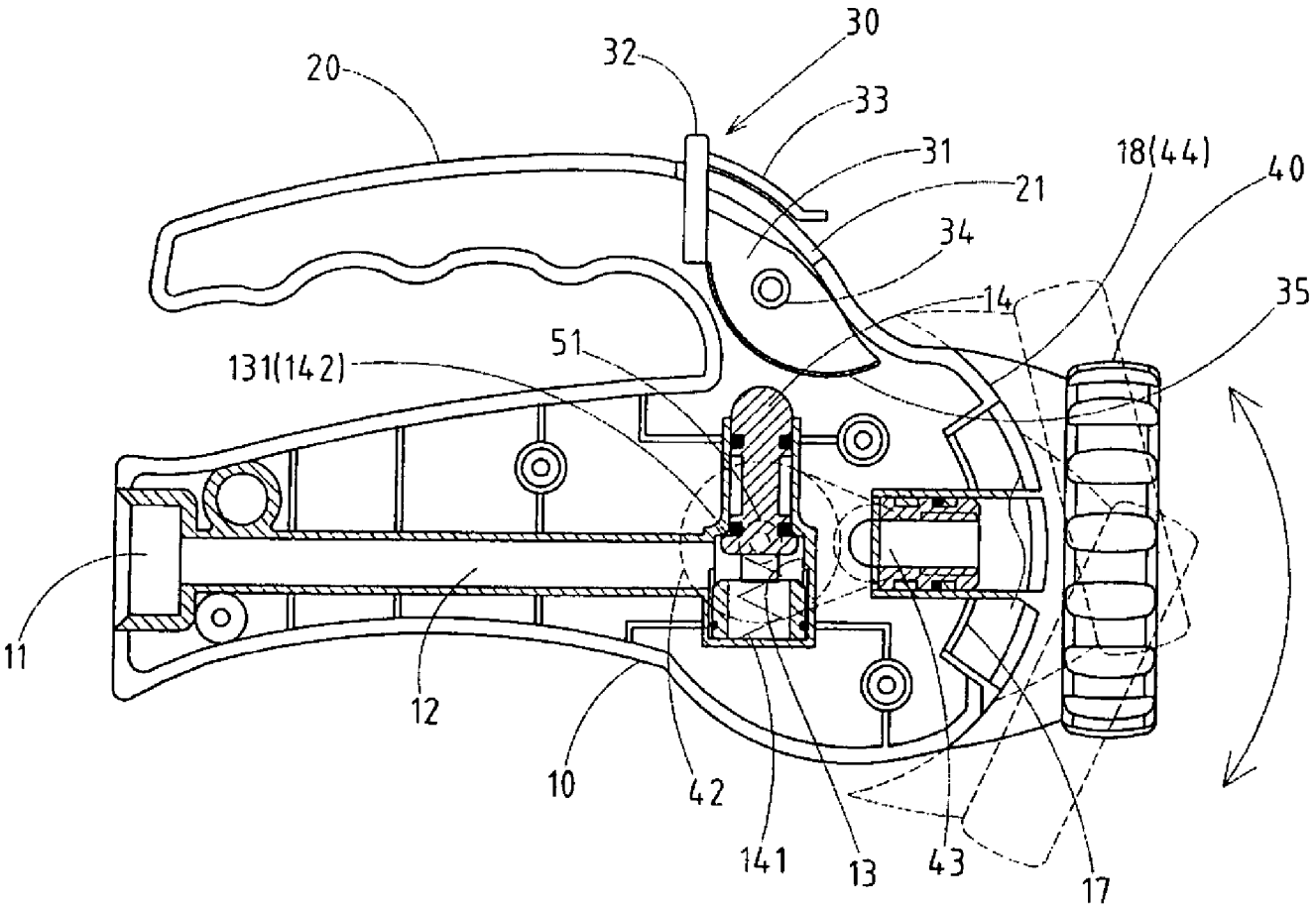
FIG. 6 shows a sectional view of a schematic drawing of the whirling design of the outlet of the present invention.
Figure 7:
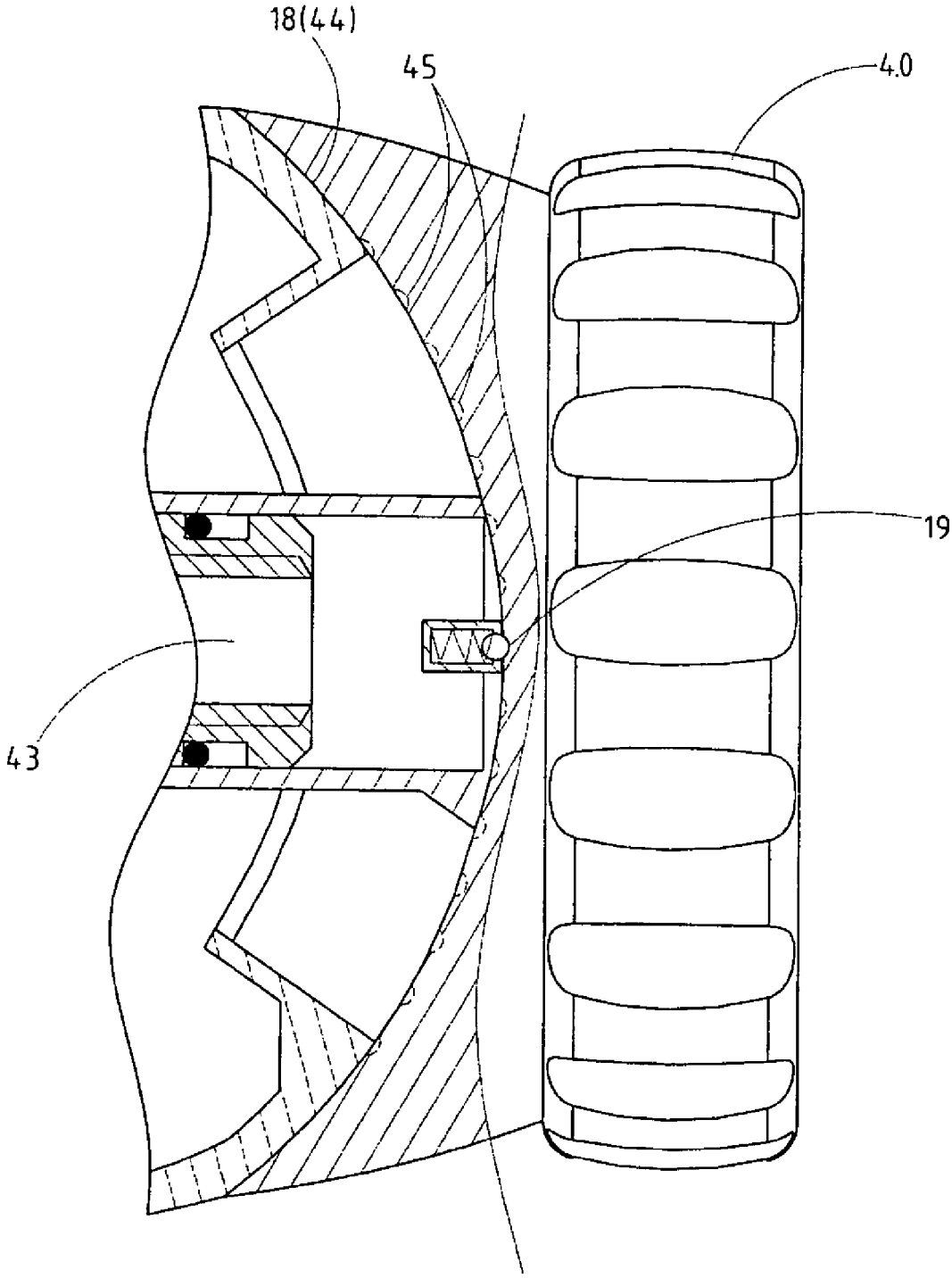
FIG. 7 shows a perspective view of the outlet's division and positioning.
Figure 8:
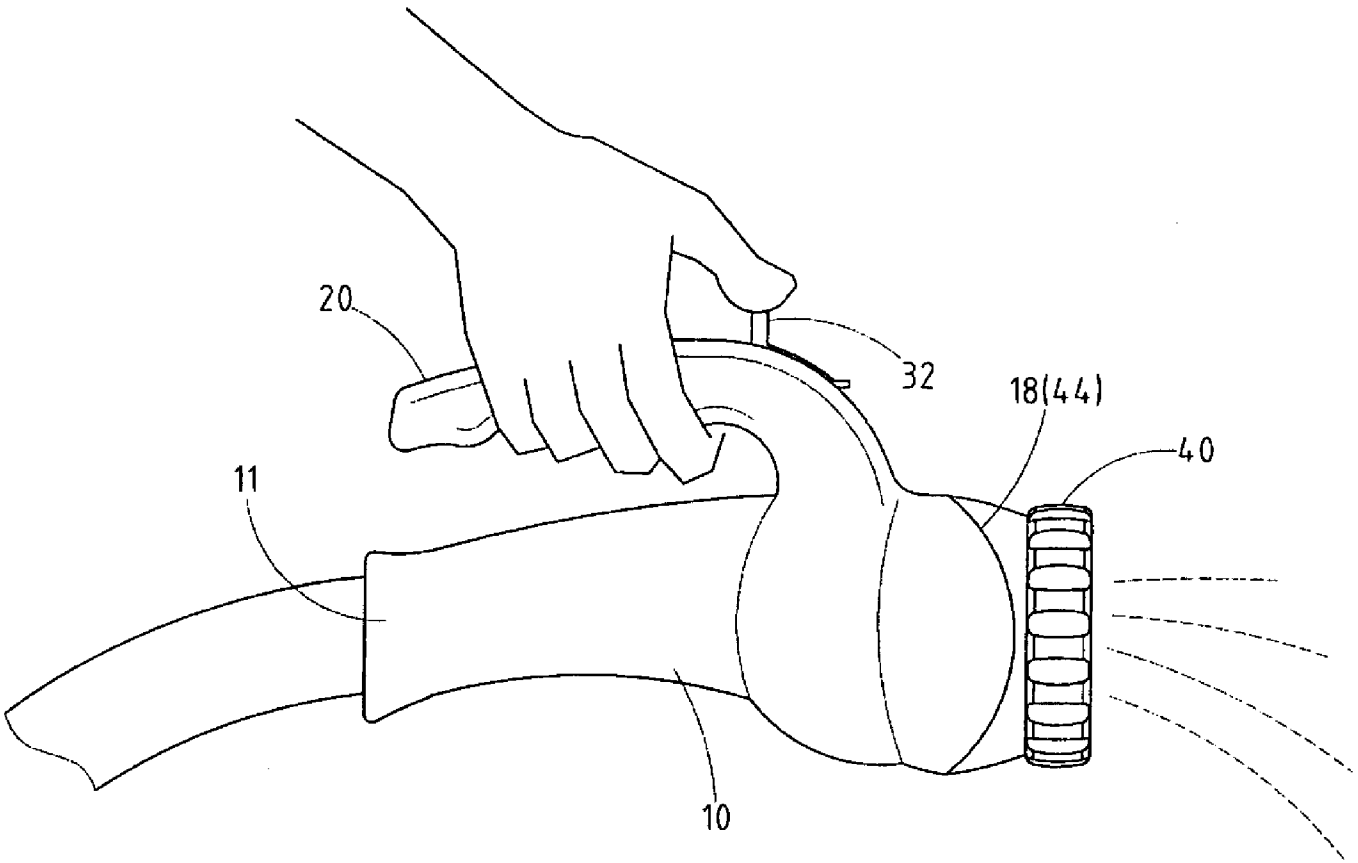
FIGS. 8–9 show elevation views of the present invention at operation.

As shown in FIG. 6, the arc dent 44 can be provided with some separate concavities 45 along the whirling direction of the rotary outlet 40, so a flexible button 19 shall be mounted at the arc convex 18 of the front end of airbrush so as to push in a corresponding concavity 45 along with the rotation of the outlet 40, with the aim of serving the purpose of division and positioning.

The grip 20 at the outer flank of the hose nozzle 10 is an integral part of carrying handle. The front end of the grip 20 is connected to the water control post 14 corresponding to the hose nozzle 10 while the back end of the grip 20 shall be of a suspended type, so as to place the control button 30 at the fore part of the grip 20. The control button 30 comprises a board base 31, a button 32 and a cover plate 33, of which the board base 31 can be connected to two side walls at the fore part of the grip 20 via a shaft bolt 34. The bottom of the board base 31 is available with a braking surface 35 corresponding to the top of the water control post 14. To offer a convenient press/push, the button 32 will protrude an opening 21 at the top of the fore part of the grip 20. The cover plate 33 will protrude the front side of the button 32 to cover the opening 21.

The localizer of the connector 42 and insert notch 15 comprises a screw column 51 at the center of insert notch, a punching hole 52 at the center of the connector 42 and a bolt 53. When the bolt 53 is screwed into the screw column 51 after crossing the punching hole 52, it can fix the connector 42 and insert notch 15.

The embodiment of the present invention described above can apply to the following conditions.

Figure 2:
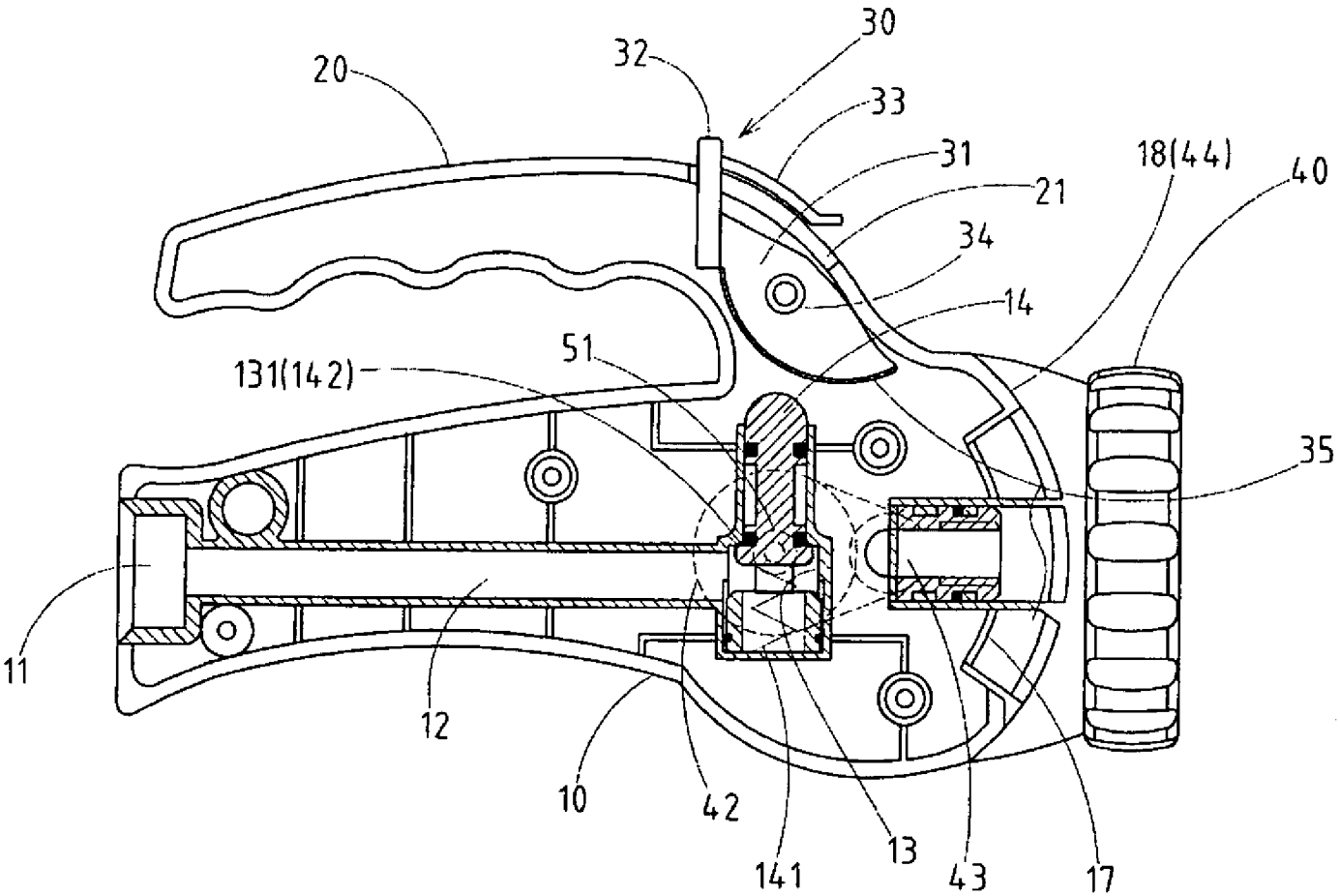
FIG. 2 shows an exploded cross-sectional view, with the water flow at a closing state.

As shown in FIG. 2, where the rotary outlet 40 is in a watertight state, the top of the water control post 14 has not yet contacted the braking surface 35 at bottom of the control button 30, so the passage notch 16 is not connected to the water valve 13, the water is inaccessible to the outlet 40.

Figure 3:
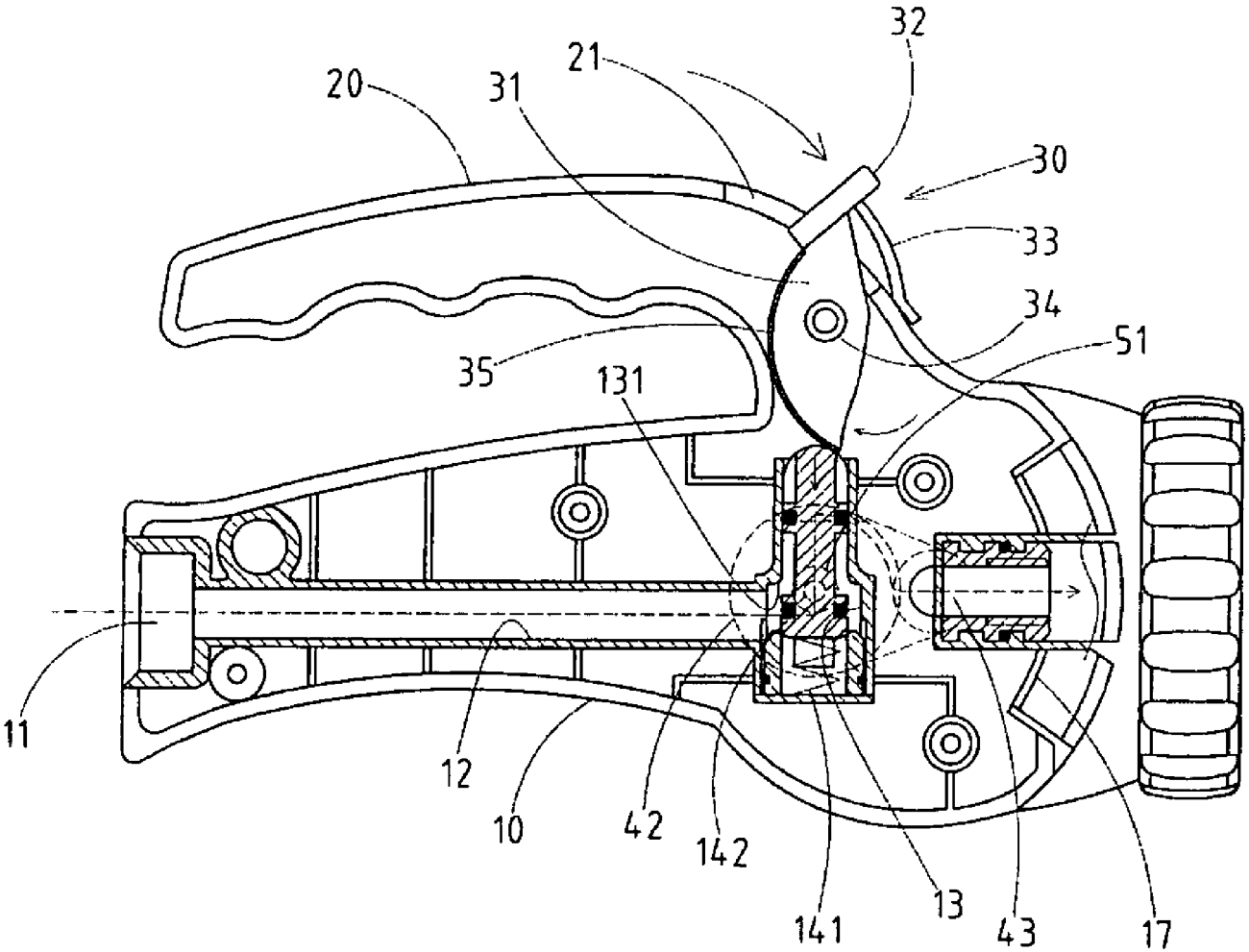
FIG. 3 shows an exploded cross-sectional view, with the water flow at an opening state.

As shown in FIGS. 3–4, when the end-user press the control button 30, the braking surface 35 will push the water control post 14 and make it shift downwards. In such case, the passage notch 16 is connected to the water valve 13, so the water can be accessible to the spraying hole 41 of the rotary outlet 40 through the conduit 12, water valve 13, passage notch 16 and water hole 43 of the connector 42.

Figure 9:
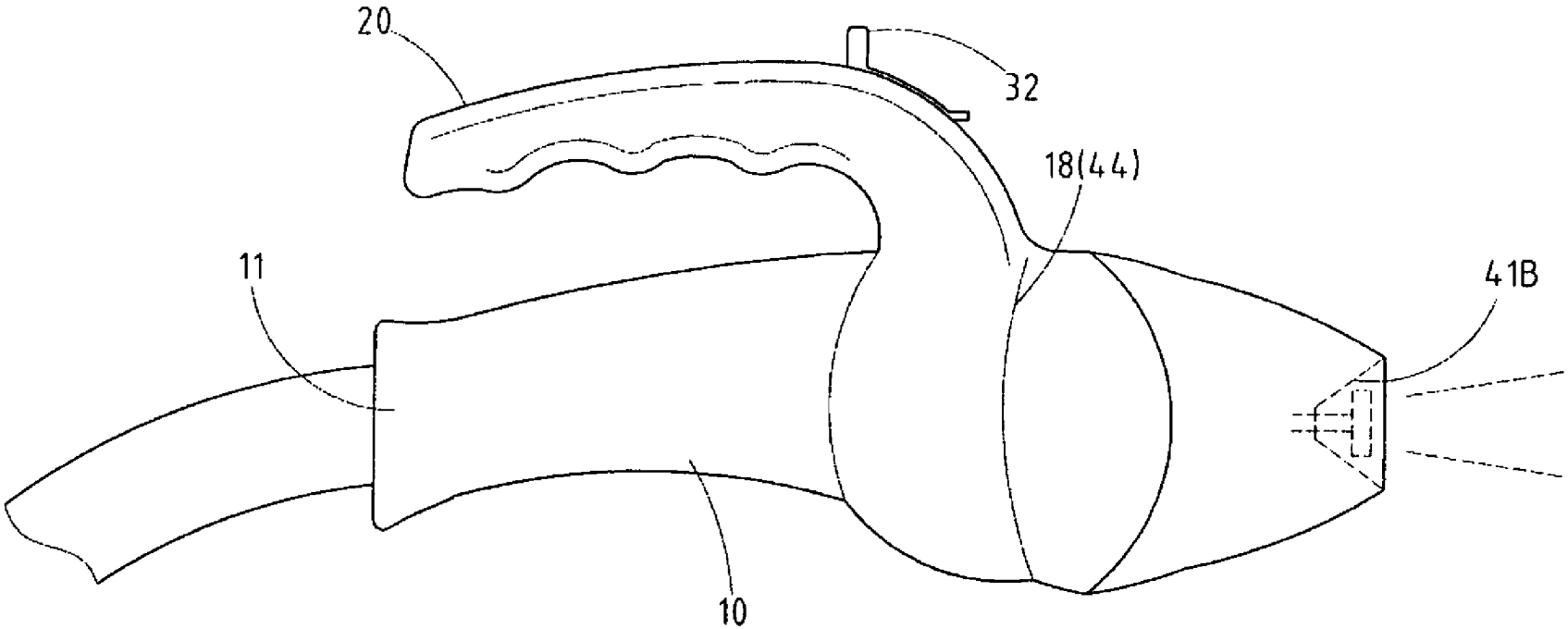

Additionally, the spraying hole of the present invention's garden hose nozzle is available in both a flower-like spraying hole 41 (as shown in FIG. 1) and a single-hole spraying hole 41B (as shown in FIG. 9).

I claim:

1. A garden hose nozzle comprising:

a hose nozzle, with its outer flank provided with a grip and back end provided with a hose connecting end, the hose-connecting end being connected to a conduit within the hose nozzle, which is linked to a water valve, the water valve being equipped with a water control post under control of a control button outside the hose nozzle for its start-up/close state, a spring being placed between a bottom of the water control post and a lower wall of the water valve, so as to enable the water control post to eject toward the control button until a flange of the water control post stops at the shoulder of the water valve;

a rotary outlet provided at a front end of the hose nozzle, an end surface of the rotary outlet having a spraying hole, the rotary outlet having a connector at one side of the hose nozzle, a water hole being formed in the connector linking to the spraying hole, an insert notch being at the hose nozzle's one side adjacent to the water valve, the insert notch having a passage notch connecting the water valve, the start-up and close state of the passage notch being under control of the water control post, the front end of the hose nozzle being provided with a passage notch, the connector of the rotary outlet crossing the hose nozzle and the insert notch, after fixation by localizers, a whirling state that the connector and the rotary outlet rotate about the insert notch is produced.

2. The garden hose nozzle defined in claim 1, wherein an arc dent is provided at one side of the rotary outlet facing the hose nozzle, thus enabling the front end of the hose nozzle to be provided with a shape of an arc convex.

3. The garden hose nozzle defined in claim 2, wherein said arc dent has a plurality of separate concavities along a whirling direction of the outlet, a flexible button is mounted at the arc convex of the front end of the hose nozzle and positioned in a corresponding concavity along with the rotation of the rotary outlet.

4. The garden hose nozzle defined in claim 1, wherein said grip at the outer flank of the hose nozzle is an integral part of a handle having a front end connected to the water control post corresponding to the hose nozzle while a back end of the handle is suspended, the control button comprises a board base, a button and a cover plate, the board base is connected to two side walls at the fore part of the grip and having a bottom provided with a braking surface corresponding to a top of the water control post, the button will protrude an opening at the top of the fore part of the grip and cover plate will protrude the front side of the button to cover the opening.

5. The garden hose nozzle defined in claim 1, wherein said localizer of the connector and insert notch comprises a screw column at a center of the insert notch, a punching hole at a center of the connector and a bolt, and when the bolt is screwed into the screw column after crossing the punching hole, it can fix the connector and the insert notch.

* * * * *